US005845498A

United States Patent [19]

Matsui et al.

[11] Patent Number: 5,845,498

[45] Date of Patent: Dec. 8, 1998

[54] PULSE TUBE REFRIGERATOR

[75] Inventors: Takayuki Matsui; Tatsuo Inoue, both of Anjo, Japan

[73] Assignee: Aisin Seiki Kabushiki Kaisha, Kariya, Japan

[21] Appl. No.: 841,570

[22] Filed: Apr. 30, 1997

[30] Foreign Application Priority Data

Apr. 30, 1996 [JP] Japan ..... 8-109102

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 5,269,147 12/1993 Ishizaki et al. ..... 62/6
5,412,952 5/1995 Ohtani et al. ..... 62/6
5,435,136 7/1995 Ishizaki et al. ..... 60/517

*Primary Examiner*—Ronald C. Capossela
*Attorney, Agent, or Firm*—Oblon, Spivak, McClelland, Maier & Neustadt, P.C.

[57] ABSTRACT

A pulse tube refrigerator according to the present invention is capable of performing cryogenic operation sufficiently. The cryostat includes regenerators and pulse tubes. Each regenerator has a cold stage at an upper end thereof. Each pulse tube has a low-temperature end portion at a lower end thereof and a high-temperature end portion thereof, the low-temperature end portion being located lower than the cold stage. The cold stage and the low-temperature end portion are connected to each other through a line whose cubic volume is substantially negligible in comparison with that of the pulse tube. Since the pulse tube has working gas of relatively high density in an upper portion thereof and working gas of relatively low density in a lower portion thereof, there is no convection of working gas induced by the gravity. Thus, the cryostat performs cryogenic operation sufficiently without being adversely affected.

22 Claims, 9 Drawing Sheets

PULSE TUBE REFRIGERATOR

INCORPORATION BY REFERENCE

The entire disclosure of Japanese Patent Application No. Hei 8-109102 filed on Apr. 30, 1996, including the specification, drawings and abstract, is incorporated herein by reference in its entirety.

BACKGROUND OF THE INVENTION

1. Field of the Invention

The present invention relates to a pulse tube refrigerator. The pulse tube refrigerator is, for example, suited for use as a cryopump.

2. Description of the Related Art

A cryostat of earlier technology such as reverse Stirling cycle type refrigerator or Gifford-MacMahon type refrigerator is cryogenic temperature generating system which necessitates a moving member such as a piston near a cold stage. On the other hand, a pulse tube refrigerator has a pulse tubein which working gas is expanded to achieve a desired cryogenic temperature Since the pulse tube has a substantially hollow body and is interposed between a cold stage and a moving member, it can be achived that the moving member is far away from the cold stage. Hence, the pulse tube refrigerator has a much simpler structure than the above-mentioned cryostat of earlier technology, and is therefore advantageous in terms of manufacturing cost, durability, operational reliability, low vibration level and the like.

A pulse tube refrigerator 1 of earlier technology, as shown in FIG. 1, includes a first regenerator 3 which has a first cold stage 5 at a lower end thereof. A first pulse tube 7, which is connected to the first cold stage 5, has at a lower end thereof a low-temperature end portion 7L in which the temperature of working gas is the lowest. In this arrangement, the low-temperature end portion 7L is located closest to the first cold stage 5. On the other hand, the first pulse tube 7 has at an upper end thereof a high-temperature end portion 7H in which the temperature of working gas is the highest. Similarly, the cryostat 1 includes a second regenerator 13 which has a second cold stage 15 at a lower end thereof. A second pulse tube 17, which is connected to the second cold stage 15, has a low-temperature end portion 17L at a lower end thereof.

As shown in FIG. 1, the cryostat 1 further includes a compressor 21, low-pressure supply valves 22, 24, 26, high-pressure supply valves 23, 25, 27, and a valve drive motor 28. These elements constitute a phase shifter and a pressure oscillation source.

As described above, the pulse tube refrigerator of earlier technology has many advantages, and thus is desired to be applied to a variety of fields. The present inventors, however, have noticed in the course of their developmental activities that this type of cryostat has the following problems.

That is, in order to use the pulse tube refrigerator as a cooling device of a cryopump, the regenerator needs to have the cold stage at the upper end thereof. If the pulse tube refrigerator 1 shown in FIG. 1 is turned upside down, the low-temperature end portion 7L is located at the upper end of the pulse tube 7, while the high-temperature end portion 7H is located at the lower end thereof.

In this arrangement, since the pulse tube 7 is substantially a hollow body, the gravity may induce convection of working gas therein. This is because working gas in the low-temperature end portion 7L located at the upper end of the pulse tube 7 has relatively high density, whereas working gas in the high-temperature end portion 7H located at the lower end thereof has relatively low density. The occurrence of convection is undesirable, because it substantially deteriorates cryogenic efficiency.

SUMMARY OF THE INVENTION

It is thus an object of the present invention to solve the foregoing problems.

It is another object of the present invention is to provide a cryostat of the above-described type that is capable of performing cryogenic operation as sufficiently as the earlier type, even though the cold stage is located at the upper end of the regenerator.

Furthermore, it is still another object of the present invention to make the structure of the cryostat as simple as possible.

In order to achieve at least one of the above-mentioned objects, according to a first aspect of the present invention, there is provided a pulse tube refrigerator constructed as follows. That is, the cryostat includes at least one regenerator, at least one pulse tube, at least one line, a phase shifter and a pressure oscillation source. The regenerator has a cold stage at an upper end thereof. The pulse tubehas a low-temperature end portion at a lower end thereof and a high-temperature end portion at an upper end thereof, and the low-temperature end portion is located lower than the cold stage. The line connects the low-temperature end portion of the pulse tube to the cold stage. The phase shifter is connected to the high-temperature end portion of the pulse tube, and the pressure oscillation source is connected to the regenerator.

According to a second aspect of the present invention, the cubic volume of the line may be substantially negligible in comparison with the cubic volume of the pulse tube. For example, the former is less than one-tenth of the latter. In this case, the line may be made of a material of good thermal conductivity such as copper, lead or the alloy thereof, so that the line can be used as part of the regenerator.

Furthermore, according to a third aspect of the present invention, the cubic volume of the line is substantially negligible in comparison with the cubic volume of the pulse tube. In this case, the line may be made of a material of poor thermal conductivity such as stainless steel, so that the line can be used as part of the pulse tube.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

The present invention will be described hereinafter based on preferred embodiments thereof with reference to the accompanying drawings.

First Preferred Embodiment

Figure 1:
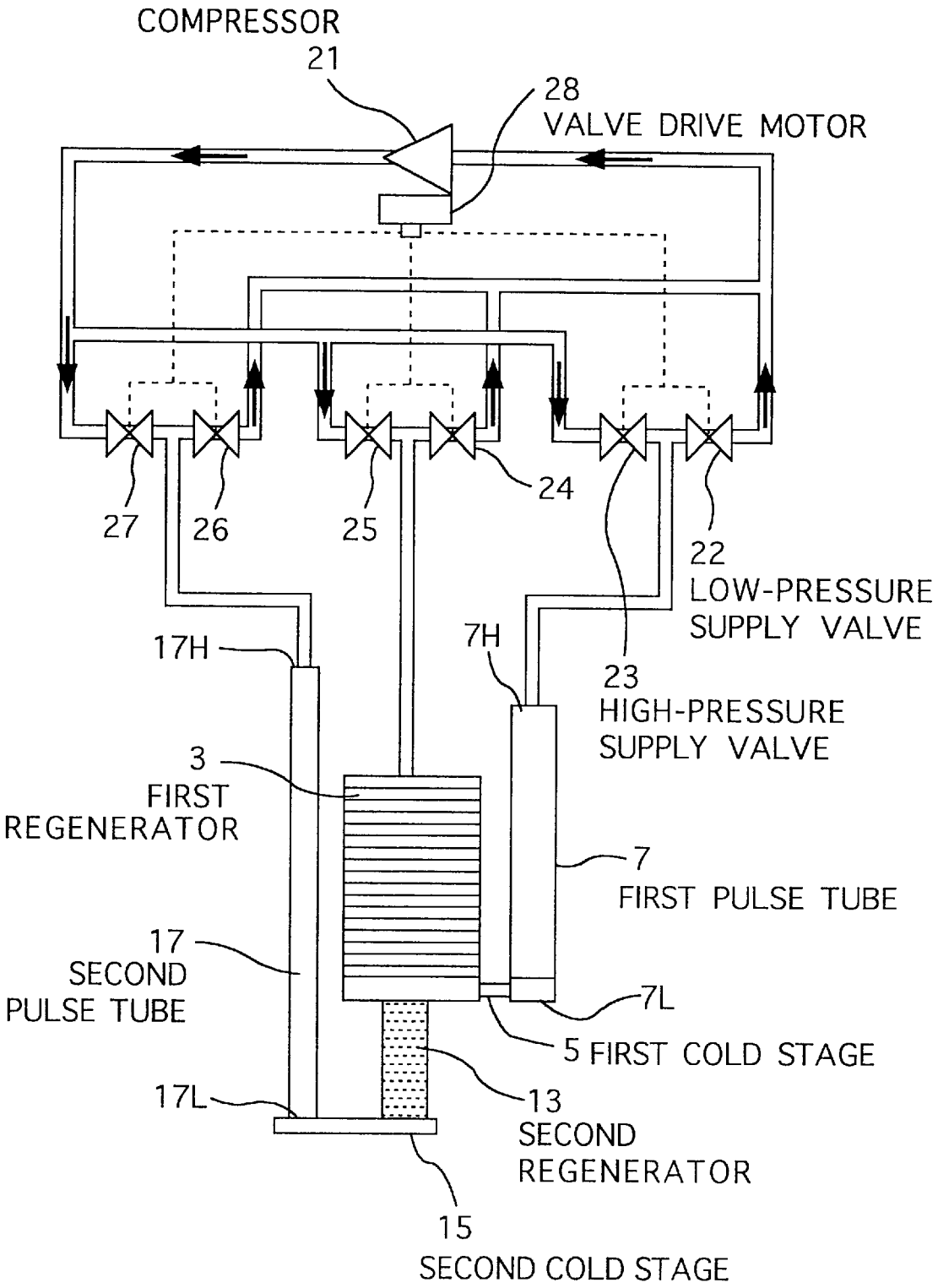
FIG. 1 is a configuration diagram showing a pulse tube refrigerator of earlier technology.
Figure 2:
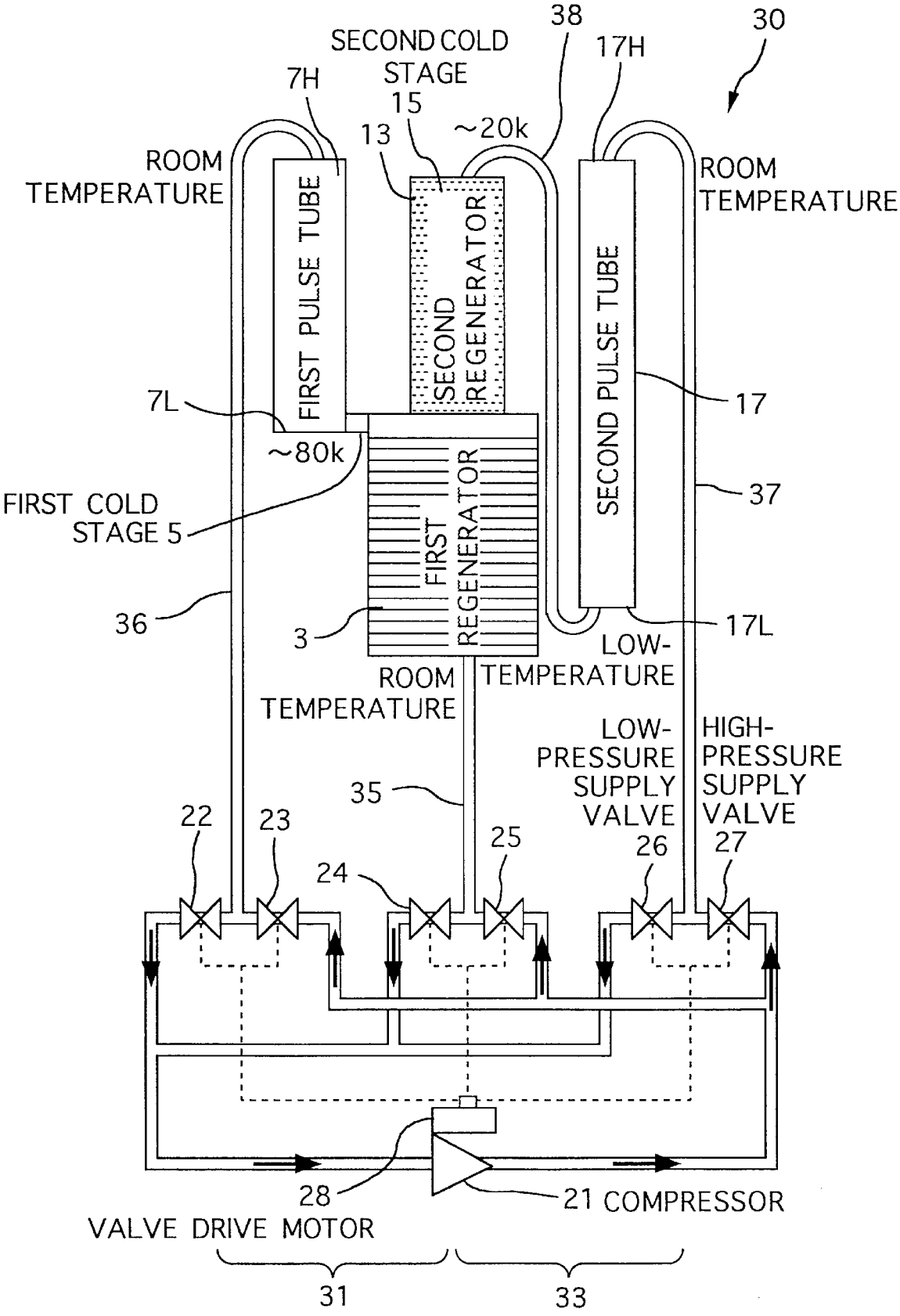
FIG. 2 is a configuration diagram showing a pulse tube refrigerator according to a first embodiment of the present invention.

According to a first embodiment of the present invention as shown in FIG. 2, a pulse tube refrigerator 30 includes a first cryogenic temperature generating system 31 and a second cryogenic temperature generating system 33.

In the first cryogenic temperature generating system 31, there is disposed vertically a first regenerator 3, which has a first cold stage 5 at an upper end thereof. In principle, the first regenerator 3 may be made of any material of high thermal conductivity. In this embodiment, the regenerator 3 has a copper mesh formed therein. A first pulse tube 7, which is vertically disposed, has a high-temperature end portion 7H at an upper end thereof and a low-temperature end portion 7L at a lower end thereof. In principle, the first pulse tube7 may be made of any material of low thermal conductivity. In this embodiment, the first pulse tube 7 is made of stainless steel. Since the low-temperature end portion 7L is provided at the lower end of the first pulse tube 7, there is no convection of working gas induced by the gravity.

The first regenerator 3 and the first pulse tube 7 are connected to a compressor 21 through lines 35, 36, low-pressure supply valves 24, 22 and high-pressure supply valves 25, 23 respectively. The compressor 21 is designed to apply pressure to working gas filling the first cryogenic temperature generating system 31. The low-pressure supply valves 22, 24 and the high-pressure supply valves 23, 25 are selectively opened or closed by a valve drive motor 28 at predetermined time intervals, so that working gas in the first cryogenic temperature generating system 31 is varied in pressure regularly, and that a difference in phase between working gas phase variation and working gas pressure variation is adjusted.

Although helium is used as working gas in this embodiment, the working gas may be selected arbitrarily depending on desired cryogenic temperature, desired output or the like. For example, the working gas may be argon, hydrogen or the mixture thereof with helium included. As shown in FIG. 2, the first regenerator3 is connected to the valves 24, 25 through the line 35, while the first pulse tube 7 is connected to the valves 22, 23 through the line 36. Although not shown in the figure, the lines 35, 36 may be provided with radiators respectively.

In the second cryogenic temperature generating system 33, there is disposed vertically a second regenerator 13, which has a second cold stage 15 at an upper end thereof. The second regenerator 13 is filled with lead particles. A second pulse tube 17, which is vertically disposed, has a high-temperature end portion 17H at an upper end thereof and a low-temperature end portion 17L at a lower end thereof. Since the low-temperature end portion 17L is provided at the lower end of the second pulse tube 17, there is no convection of working gas induced by the gravity.

The second regenerator 13 and the second pulse tube 17 are connected to the compressor 21 through the lines 35, 37, low-pressure supply valves 24, 26 and high-pressure supply valves 25, 27 respectively. The compressor 21 is designed to apply pressure to working gas filling the second cryogenic temperature generating system 33. The low-pressure supply valves 24, 26 and the high-pressure supply valves 25, 27 are selectively opened or closed by the valve drive motor 28 at predetermined time intervals, so that working gas in the second cryogenic temperature generating system 33 is varied in pressure regularly, and that a difference in phase between working gas phase variation and working gas pressure variation is adjusted. In this embodiment, the compressor 21, the high-pressure supply valve 25, and the low-pressure supply valve 24 are used as a pressure oscillation source, the high-pressure supply valve 23 and the low-pressure supply valve 22 are used as a first phase shifter, and the high-pressure supply valve 27 and the low-pressure supply valve 26 are used as a second phase shifter.

The operating principle of the pulse tube refrigeratoraccording to this embodiment will be described hereinafter.

When the valve drive motor 28 is activated, the low-pressure supply valve 22 is closed and the high-pressure supply valve 23 is opened. This causes high-pressure working gas to be supplied to the first pulse tube 7 through the high-pressure supply valves 23 and the line 36. Then, with a predetermined phase difference, the low-pressure supply valve 26 is closed and the high-pressure supply valve 27 is opened. This causes high-pressure working gas to be supplied to the second pulse tube 17 through the high-pressure supply valve 27 and the line 37.

Then, with a predetermined phase difference, the low-pressure supply valve 24 is closed and the high-pressure supply valve 25 is opened. This causes high-pressure working gas to be supplied to the first regenerator 3 through the high-pressure supply valve 25 and the line 35. After the high-pressure gas has been supplied to the first regenerator 3, with a predetermined phase difference, the high-pressure supply valve 23 is closed and the low-pressure supply valve 22 is opened. This causes the high-pressure gas in the first pulse tube 7 to return to the compressor 21 through the line 36 and the low-pressure supply valve 22.

Then, with a predetermined phase difference, the high-pressure supply valve 27 is closed and the low-pressure supply valve 26 is opened. This causes the high-pressure working gas in the second pulse tube 17 to return to the compressor 21 through the line 37 and the low-pressure supply valve 26. Then, with a predetermined phase difference, the high-pressure supply valve 25 is closed and the low-pressure supply valve 24 is opened. This causes the high-pressure working gas in the first regenerator 3 to return to the compressor 21 through the line 35 and the low-pressure supply valve 24.

The steps of selectively opening or closing the valves as described above constitute one operation cycle. If this operation cycle is repeated, there is generated in the pulse tube refrigerator 30 a difference in phase between working gas phase variation and working gas pressure variation. The difference in phase thus generated is a prerequisite for achieving cryogenic temperature using the P-V characteristic of gas. By controlling the valve drive motor 28 to suitably open or close the pressure supply valves, the difference in phase between working gas displacement and working gas pressure variation is adjusted optimally, thus achieving cryogenic temperature in the first cold stage 5 and the second cold stage 15.

In the first cryogenic temperature generating system 31, working gas temperature is the lowest in the first cold stage 5, which is located closest to the first regenerator 3. The first cryogenic temperature generating system 31 is able to achieve a cryogenic temperature of 80 K, thereby causing working gas in the second cryogenic temperature generating system 33 to be cooled. On the other hand, working gas temperature is the highest in the high-temperature end portion 7H of the first pulse tube 7, which is located most distant from the first regenerator 3. Accordingly, there is generated a temperature gradient in the first pulse tube 7.

The low-temperature end portion 17L of the second pulse tube 17 is located well lower than the second cold stage 15, and lower than the first cold stage 5. The low-temperature end portion 17L is connected to the second cold stage 15 through a line 38. The cubic volume of the line 38 is substantially negligible in comparison with that of the second pulse tube 17. The line 38 is made of a material of low thermal conductivity such as stainless steel, so that the low temperature of working gas in the line 38 is not affected by outside room temperature. In other words, the line 38 is used as part of the second pulse tube 17.

As shown in FIG. 2, the low-temperature end portion 17L of the second pulse tube 17 is located at substantially the same level as of the bottom of the first regenerator 3. This arrangement allows the cubic volume of the second pulse tube 17 to be increased, thus facilitating the generation of cryogenic temperature. The low-temperature end portion 17L of the second pulse tube 17 may be located arbitrarily as long as it is located lower than the second cold stage 15. If the low-temperature portion 17L is located higher than the second cold stage 15, the second pulse tube 17 extends further upward therefrom, which substantially increases the space for the entire cryostat and causes structure complication thereof.

In this embodiment, the first pulse tube 7 has the high-temperature end portion 7H at the upper end thereof, while the second pulse tube 17 has the high-temperature end portion 17H at the upper end thereof, the high-temperature end portions 7H, 17H being located substantially at the same level. Furthermore, the second cold stage 15 of the second regenerator 13 is also located substantially at the same level as of the high-temperature end portions 7H, 17H, thus simplifying the structure of the entire cryostat.

The pulse tube refrigerator in this embodiment is capable of generating cryogenic temperature as low as 80 K in the first cold stage 5, and cryogenic temperature as low as 20 K in the second cold stage 15.

Figure 3:
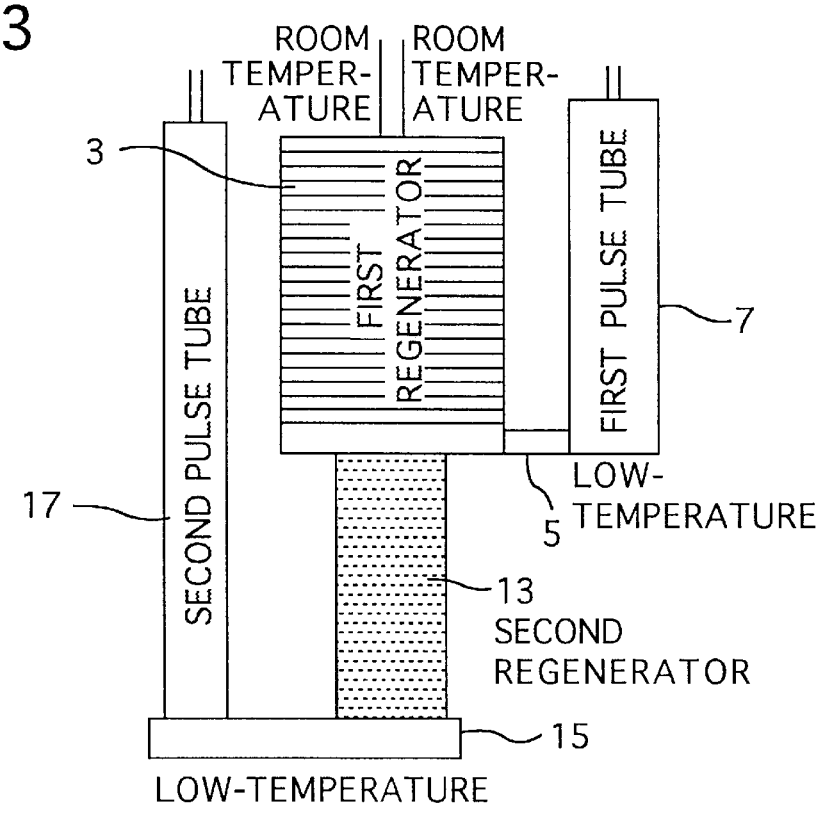
FIG. 3 is a configuration diagram showing an essential part of the pulse tube refrigerator of earlier technology.
Figure 4:
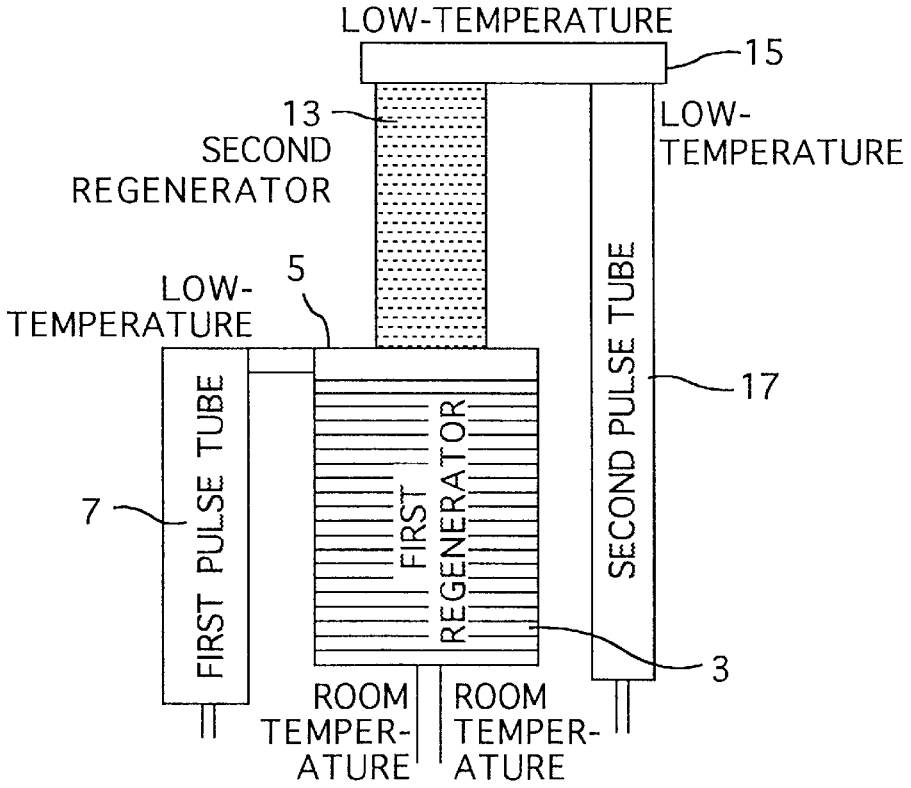
FIG. 4 is a configuration diagram showing the pulse tube refrigerator shown in FIG. 3 inverted for the purpose of comparison.

Referring now to FIGS. 3 and 4, the pulse tube refrigerator in this embodiment, which is constructed as shown in FIG. 2 and operates as described above, is arranged differently for the purpose of comparison. FIG. 3 shows an earlier arrangement, whereas FIG. 4 shows an arrangement according to the present invention, which is obtained by inverting the arrangement shown in FIG. 3 by 180 degrees.

In the arrangement as shown in FIG. 3, the first and second cold stages 5, 15 are located at the lower ends of the first and second cryogenic temperature storage units 3, 13 respectively. In this case, there is generated a cryogenic temperature as low as 44 K in the first cold stage 5, and 9 K in the second cold stage 15.

In the arrangement as shown in FIG. 4, on the other hand, there is generated a cryogenic temperature no lower than 145 K in the first cold stage 5, and 42 K in the second cold stage 15.

Second Preferred Embodiment

Figure 5:
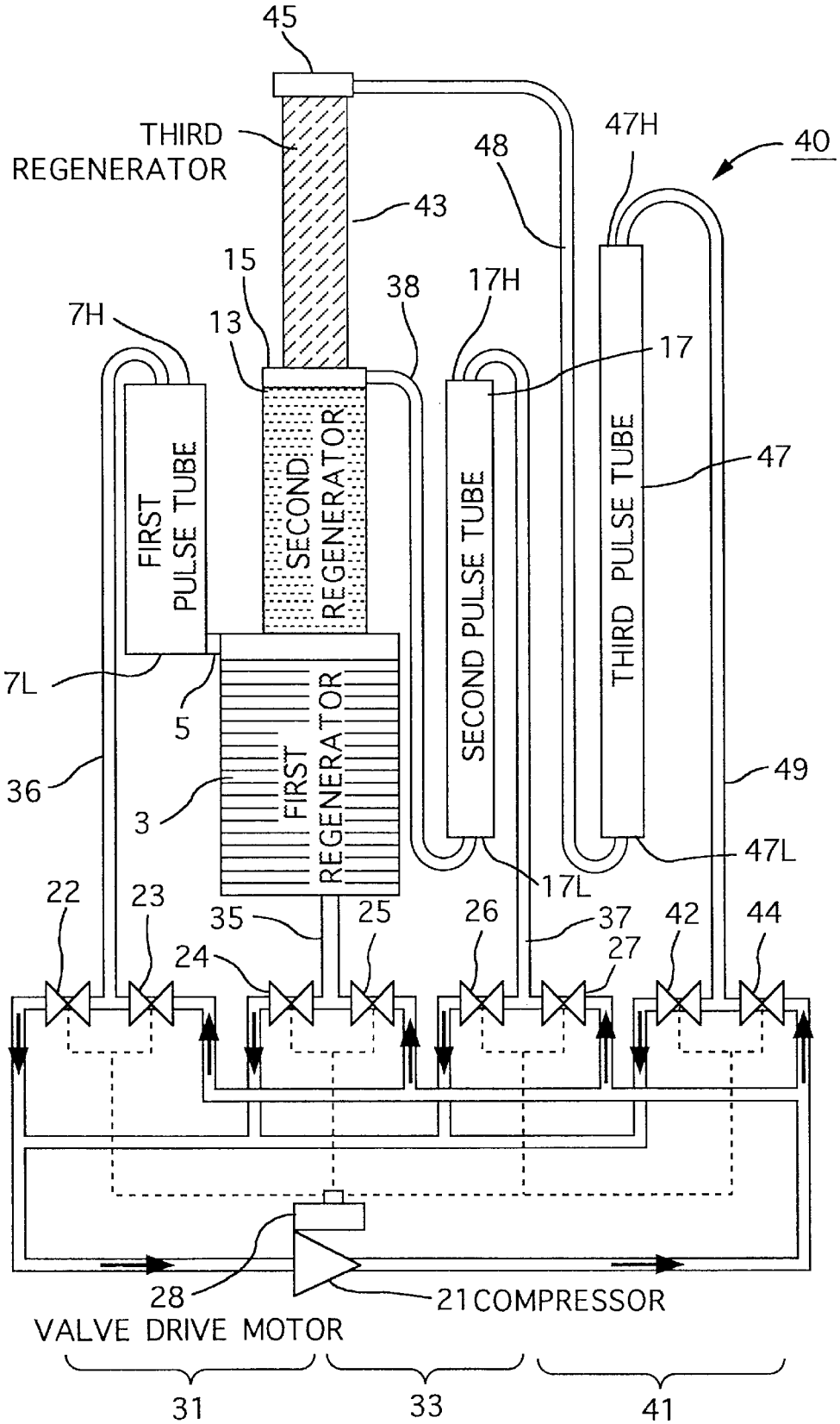
FIG. 5 is a configuration diagram showing a pulse tube refrigerator according to a second embodiment of the present invention.

FIG. 5 shows a pulse tube refrigerator 40 according to a second embodiment of the present invention, in which a third cryogenic temperature generating system 41 is provided in addition to the cryostat as shown in FIG. 2.

In the third cryogenic temperature generating system 41, a third regenerator 43 is vertically disposed. The third regenerator 43 has a third cold stage 45 at an upper end thereof. A third pulse tube 47, which is vertically disposed, has a high-temperature end portion 47H at an upper end thereof and a low-temperature end portion 47L at a lower end thereof. Since the low-temperature end portion 47L is provided at the lower end of the third pulse tube 47, there is no convection of working gas induced by the gravity.

The third regenerator 43 and the third pulse tube 47 are connected to the compressor 21 through the lines 35, 49, low-pressure supply valves 24, 42 and high-pressure supply valves 25, 44 respectively. The compressor 21 is designed to apply pressure to working gas filling the third cryogenic temperature generating system 41. The low-pressure supply valves 24, 42 and the high-pressure supply valves 25, 44 are selectively opened or closed by the valve drive motor 28 at predetermined time intervals, so that working gas in the third cryogenic temperature generating system 41 is varied in pressure regularly, and that a difference in phase between working gas phase variation and working gas pressure variation is adjusted.

The low-temperature end portion 47L of the third pulse tube 47 is located well lower than the third cold stage 45, and lower than the first and second cold stages 5, 15. The low-temperature end portion 47L is connected to the third cold stage 45 through a line 48. The cubic volume of the line 48 is substantially negligible in comparison with that of the third pulse tube47. The line 48 is made of a material of low thermal conductivity such as stainless steel, so that the low temperature of working gas in the line 48 is not affected by outside room temperature. In other words, the line 48 is used as part of the third pulse tube 47.

The operating principle of the pulse tube refrigeratorin this embodiment is substantially the same as of the first embodiment, and therefore will not be described.

Since the cryostat in this embodiment is additionally provided with the third cryogenic temperature generating system 41, it is able to generate a cryogenic temperature lower than the cryostat of the first embodiment. Furthermore, the cryostat may be made to have a large capacity, if necessary.

Third Preferred Embodiment

A pulse tube refrigerator 50 according to a third embodiment of the present invention will be described with reference to FIG. 6.

In the cryostat 50, the compressor 21 and the valve drive motor 28 of the second embodiment are replaced with a compression piston 51 and a compression cylinder 52, while the supply valves 22–27, 42, 44 of the second embodiment are replaced with expansion pistons 53, 55, 57 and expansion cylinders 54, 56, 58. The compression piston 51 and the compression cylinder 52 serve as pressure oscillation source for first through third cryogenic temperature generating systems 31*a*, 33*a*, 41*a*. The expansion pistons 53, 55, 57 and the expansion cylinder 54, 56, 58 serve as phase adjuster for the first, second and third cryogenic temperature generating systems 31*a*, 33*a*, 41*a* respectively.

Fourth Preferred Embodiment

Figure 7:
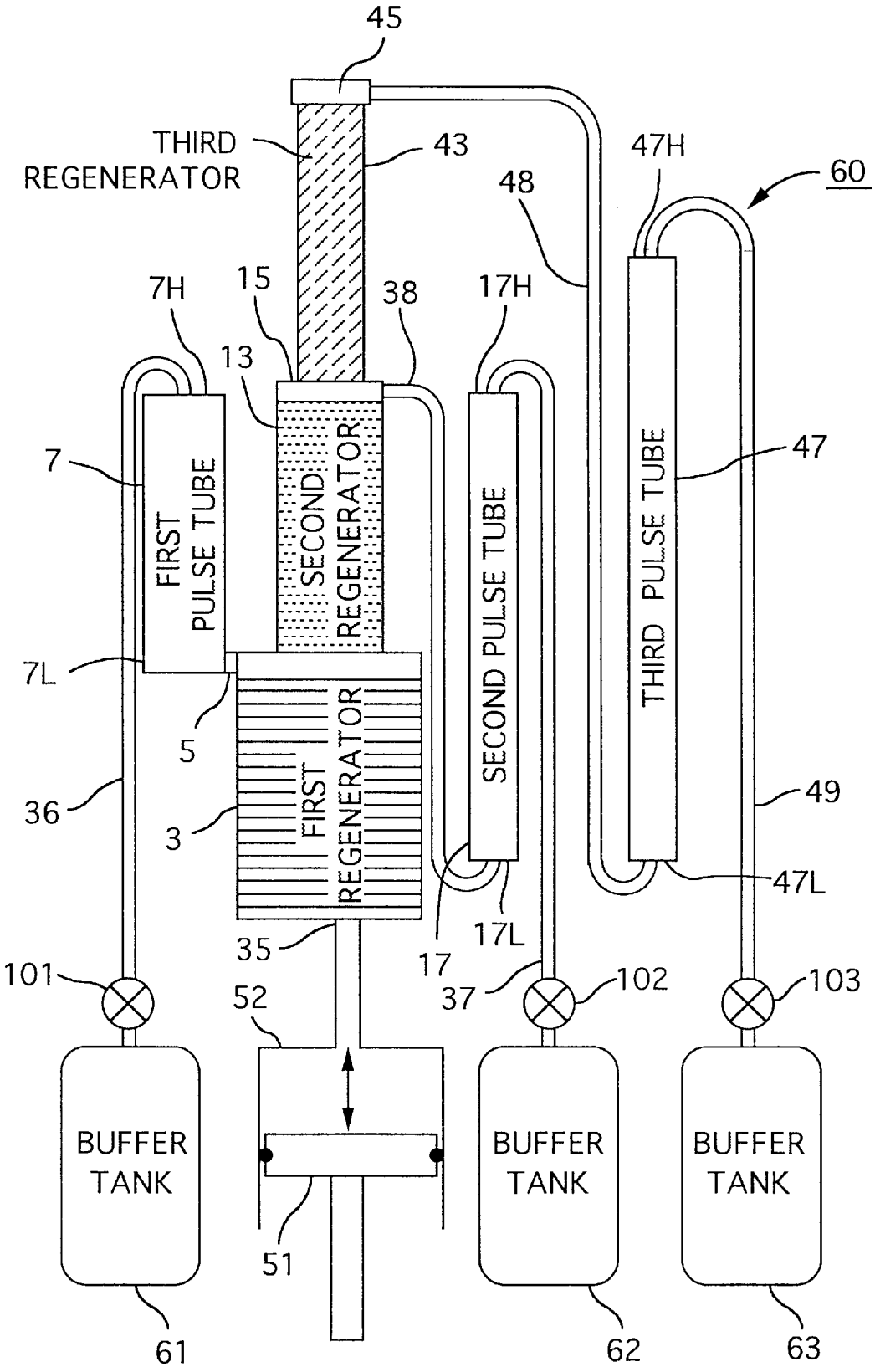
FIG. 7 is a configuration diagram showing a pulse tube refrigerator according to a fourth embodiment of the present invention.

FIG. 7 shows a pulse tube refrigerator 60 according to a fourth embodiment of the present invention.

Figure 6:
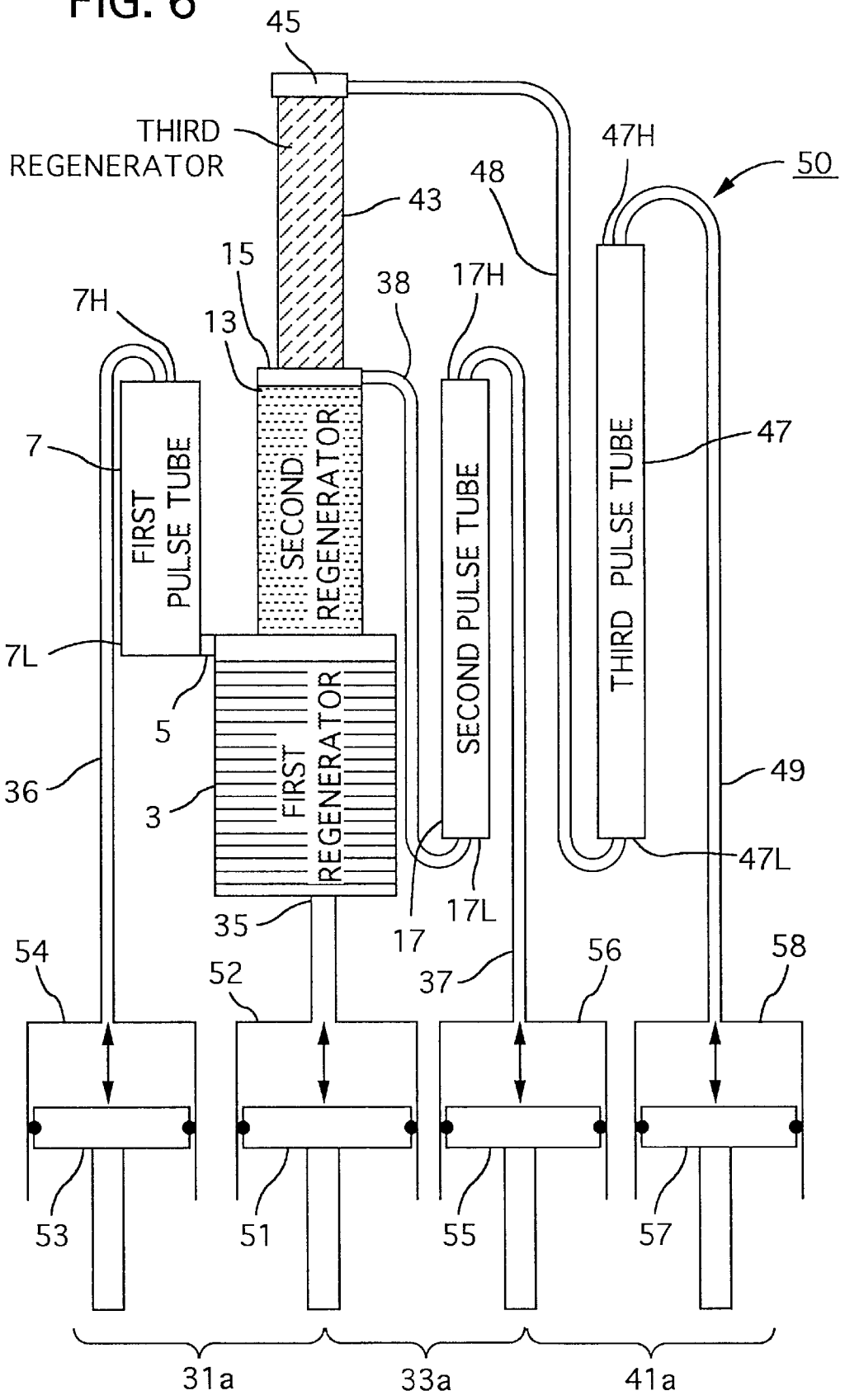
FIG. 6 is a configuration diagram showing a pulse tube refrigerator according to a third embodiment of the present invention.

The pulse tube refrigerator 60 is provided with buffer tanks 61, 62, 63, and orifice 101, 102, 103, which serve as phase adjuster for the first through third cryogenic temperature generating systems 31*a*, 33*a*, 41*a* shown in FIG. 6 respectively.

Figure 8:
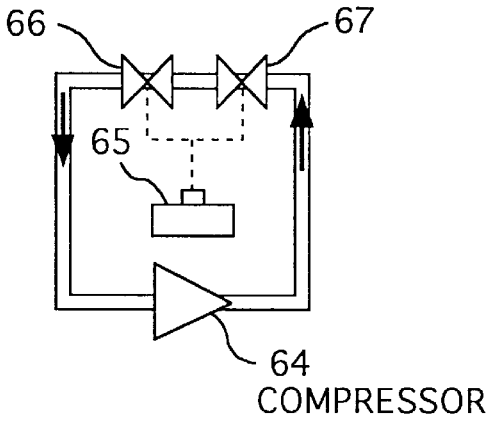
FIG. 8 is a configuration diagram showing a pressure oscillation source employed in the pulse tube refrigerator according to the fourth embodiment of the present invention.

In FIG. 8, the compression piston 51 and the compression cylinder 52 are employed as a pressure oscillation source. In addition, a configuration shown in FIG. 8 may be employed as pressure oscillation source, which is composed of a compressor 64, a valve drive motor 65, a low-pressure supply valve 66 and a high-pressure supply valve 67. The pressure oscillation source shown in FIG. 8 operates substantially in the same manner as in the second embodiment.

Fifth Preferred Embodiment

Figure 9:
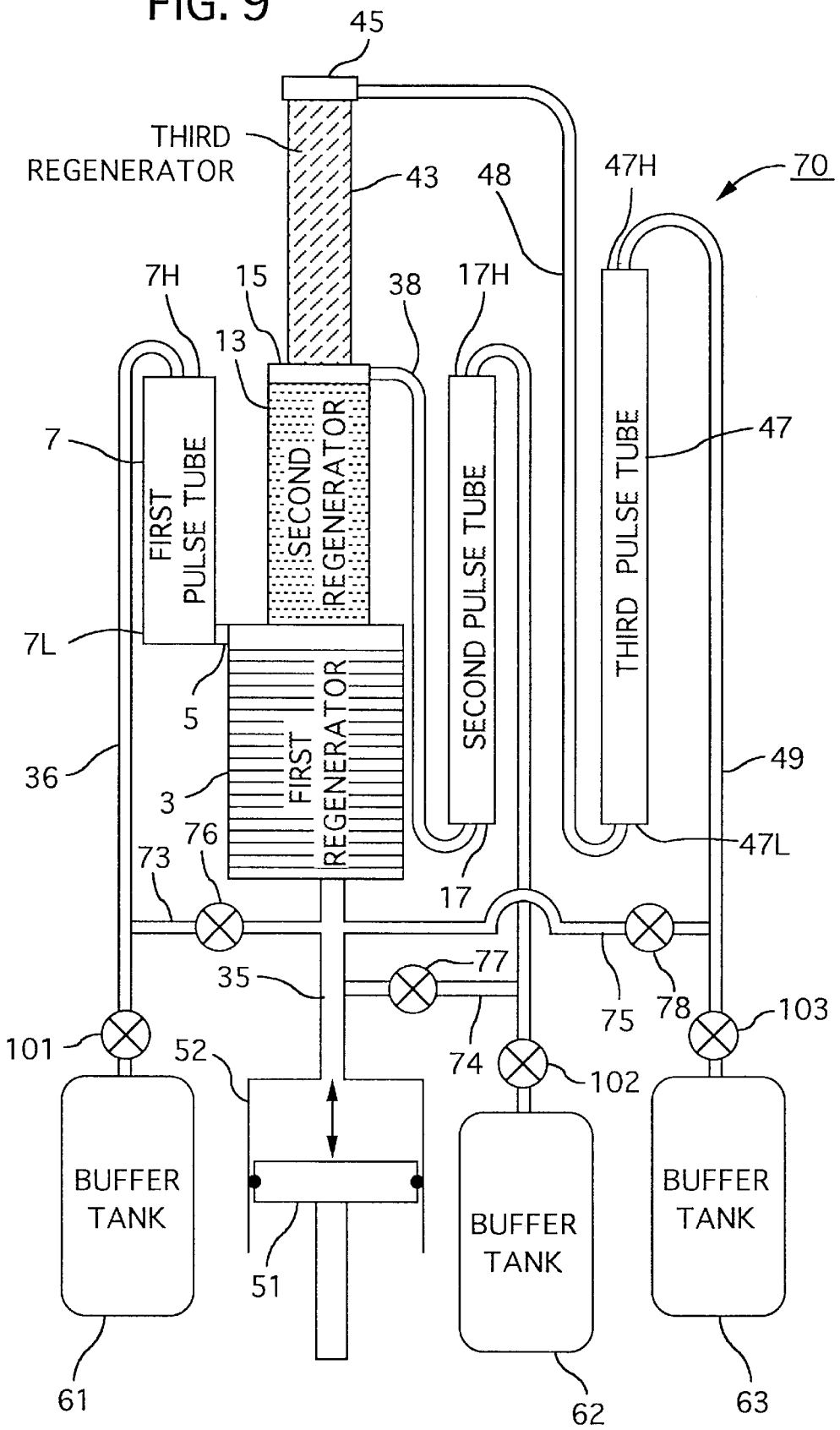
FIG. 9 is a configuration diagram showing a pulse tube refrigerator according to a fifth embodiment of the present invention.

FIG. 9 shows a pulse tube refrigerator 70 according to a fifth embodiment of the present invention.

In the cryostat 70, a first bypass line 73 and a flow regulating valve 76 are interposed between the line 35 and the line 36, a second bypass line 74 and a flow regulating valve 77 between the line 35 and the line 37, and a bypass line 75 and a flow regulating valve 78 between the line 49 and the line 35 respectively.

Sixth Preferred Embodiment

Figure 10:
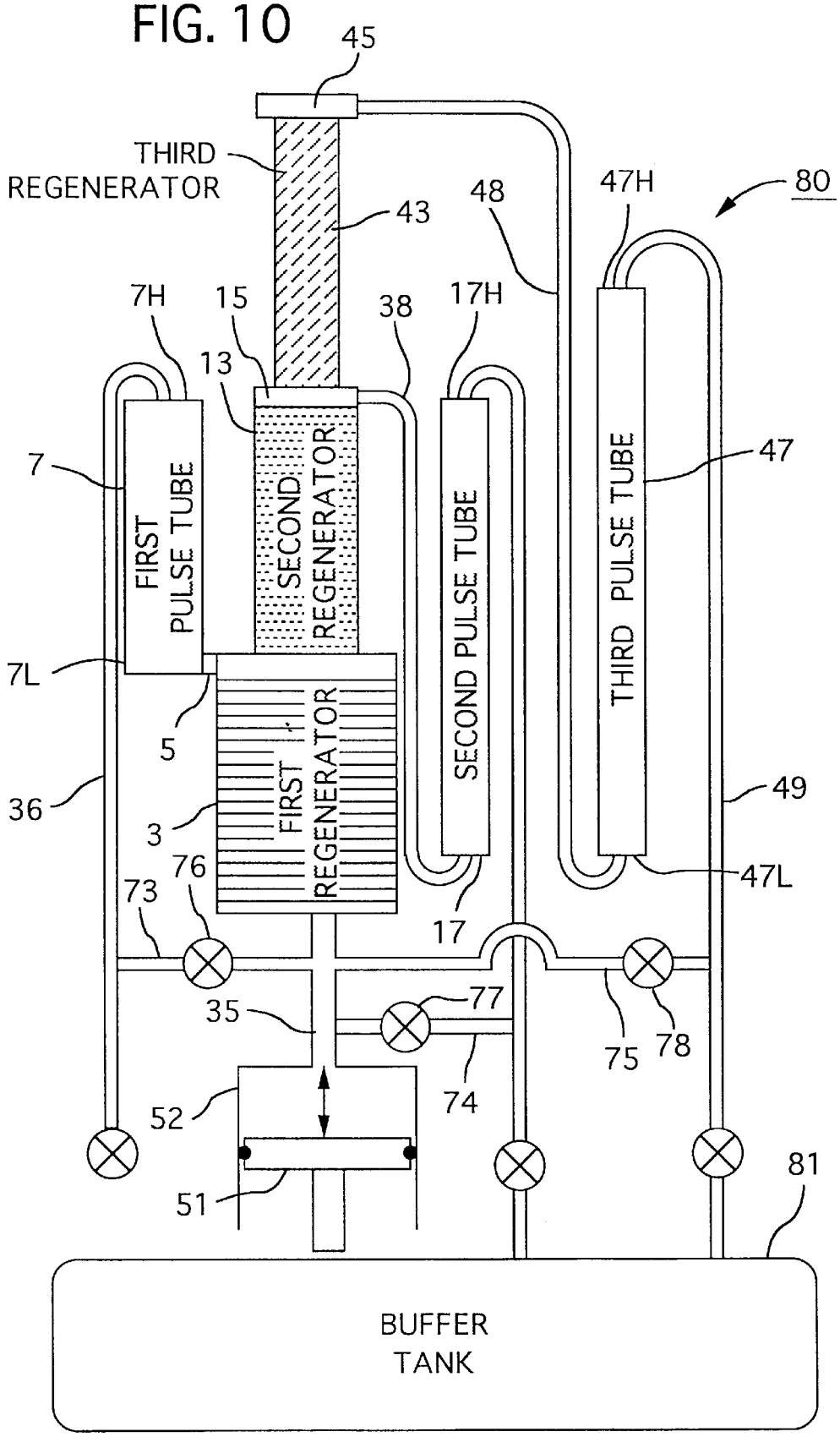
FIG. 10 is a configuration diagram showing a pulse tube refrigerator according to a sixth embodiment of the present invention.

FIG. 10 shows a pulse tube refrigerator 80 according to a sixth embodiment of the present invention.

Unlike the fifth embodiment in which there are three buffer tanks 61, 62, 63 provided, the cryostat 80 is provided with a single integrated buffer tank 81, thus reducing the number of parts drastically.

Seventh Preferred Embodiment

Figure 11:
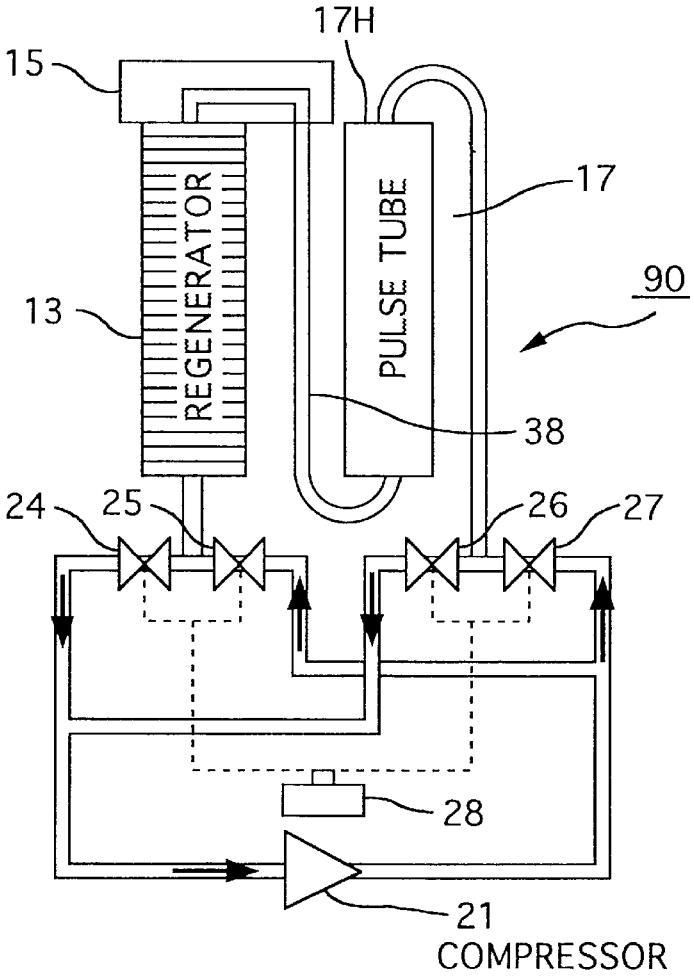
FIG. 11 is a configuration diagram showing a pulse tube refrigerator according to a seventh embodiment of the present invention.

FIG. 11 shows a pulse tube refrigerator 90 according to a seventh embodiment of the present invention.

The cryostat 90 employs only the second cryogenic temperature generating system 33 of the first embodiment shown in FIG. 2, and operates substantially in the same manner as described above. The cryostat 90 is especially useful when an extremely low temperature is not required.

A pulse tube refrigerator according to the present invention includes regenerators and pulse tubes. Each regenerator has a cold stage at an upper end thereof, while each pulse tube has a low-temperature end portion at a lower end thereof and a high-temperature end portion at an upper end thereof. The low-temperature end portion is located lower than the cold stage. In the pulse tube refrigerator thus arranged, since each pulse tube has working gas of relatively low density in a lower portion thereof and working gas of relatively high density in an upper portion thereof, there is no convection of working gas induced by the gravity. Thus, the cryostat performs cryogenic operation sufficiently without being adversely affected.

Moreover, since the low-temperature end portion of the pulse tube is located lower than the cold stage, the vertical dimension of the cryostat can be reduced significantly.

While the present invention has been described with reference to what are presently considered to be preferred embodiments thereof, it is to be understood that the invention is intended to cover various modifications and equivalent arrangements included within the spirit and scope of the appended claims.

What is claimed is:

1. A pulse tube refrigerator comprising:

at least one regenerator connecting to a cold stage at an upper end thereof;

at least one pulsation cylinder having a low-temperature end portion at a lower end thereof and a high-temperature end portion at an upper end thereof, said low-temperature end portion being located lower than said cold stage;

at least one line connecting said low-temperature end portion of said pulse tube to said cold stage;

a phase shifter connected to said high-temperature end portion of said pulse tube; and a pressure oscillation source connected to said regenerator.

2. A pulse tube refrigerator according to claim 1, wherein the cubic volume of said line is smaller than the cubic volume of said pulse tube.

3. A pulse tube refrigerator according to claim 2, wherein the cubic volume of said line is less than one-tenth of the cubic volume of said pulse tube.

4. A pulse tube refrigerator according to claim 2, wherein said line is made of a material of good thermal conductivity.

5. A pulse tube refrigerator according to claim 4, wherein said material of good thermal conductivity is selected from the group consisting of copper, lead or an alloy thereof.

6. A pulse tube refrigerator according to claim 2, wherein said line is made of a material of poor thermal conductivity.

7. A pulse tube refrigerator according to claim 2, wherein said line is made of stainless steel.

8. A pulse tube refrigerator according to claim 1, wherein a bypass line having a flow regulating valve is interposed between said pressure oscillation source and said high-temperature end portion of said pulse tube.

9. A pulse tube refrigerator comprising:

a first regenerator connecting to a first cold stage at an upper end thereof;

a second regenerator connecting to a second cold stage at an upper end thereof;

a first pulse tube having a low-temperature end portion at a lower end thereof and a high-temperature end portion at an upper end thereof, said low-temperature end portion of said first pulse tube connected to said first cold stage;

a second pulse tube having a low-temperature end portion at a lower end thereof and a high-temperature end portion at an upper end thereof, said low-temperature end portion being located lower than said second cold stage;

a second line connecting said low-temperature end portion of said second pulse tube to said second cold stage;

a first phase shifter connected to said high-temperature end portion of said first pulse tube;

a second phase shifter connected to said high-temperature end portion of said second pulse tube;

a pressure oscillation source connected to said first regenerator.

10. A pulse tube refrigerator according to claim 9, wherein the cubic volume of said second line is less than the cubic volume of said second pulse tube.

11. A pulse tube refrigerator according to claim 10, wherein said second line is made of a material of good thermal conductivity.

12. A pulse tube refrigerator according to claim 11, wherein said good thermal conductivity is copper, lead or an alloy thereof.

13. A pulse tube refrigerator according to claim 10, wherein said second line is made of a material of poor thermal conductivity.

14. A pulse tube refrigerator according to claim 10, wherein said line is made of stainless steel.

15. A pulse tube refrigerator according to claim 9, wherein a first bypass line having a first flow regulating valve is interposed between said pressure oscillation source and said high-temperature end portion of said first pulse tube, and a second bypass line having a second flow regulating valve is interposed between said pressure oscillation source and said high-temperature end portion of said second pulse tube.

16. A pulse tube refrigerator comprising:

a first regenerator connected to a first cold stage at an upper end thereof;

a second regenerator connected to a second clod stage at an upper end thereof;

a third regenerator connected to a third cold stage at an upper end thereof;

a first pulse tube having a low-temperature end portion at a lower end thereof and a high-temperature end portion at an upper end thereof, said low-temperature end portion of said first pulse tube connected to said first cold stage;

a second pulse tube having a low-temperature end portion at a lower end thereof and a high-temperature end portion at an upper end thereof, said low-temperature end portion of said second pulse tube connected to said second cold stage;

a third pulse tube having a low-temperature end portion at a lower end thereof and a high-temperature end portion at an upper end thereof, said low-temperature end portion of said third pulse tube being located lower than said third cold stage;

a third line connecting said low-temperature end portion of said third pulse tube to said third cold stage;

a first phase shifter connected to said high-temperature end portion of said first pulse tube;

a second phase shifter connected to said high-temperature end portion of said second pulse tube;

a third phase shifter connected to said high-temperature end portion of said third pulse tube; and a pressure oscillation source connected to said first regenerator.

17. A pulse tube refrigerator according to claim 16, wherein the cubic volume of said second line is less than one-tenth of the cubic volume of said second pulse tube, and cubic volume of said third line is less than one-tenth of the cubic volume of said third pulse tube.

18. A pulse tube refrigerator according to claim 17, wherein said second line is made of a material of good thermal conductivity, and said third line is made of a material of good thermal conductivity.

19. A pulse tube refrigerator according to claim 18, wherein said good thermal conductivity is copper, lead or an alloy thereof.

20. A pulse tube refrigerator according to claim 17, wherein said second line is made of a material of poor thermal conductivity, and said third line is made of a material of poor thermal conductivity.

21. A pulse tube refrigerator according to claim 17, wherein said line is made of stainless steel.

22. A pulse tube refrigerator according to claim 16, wherein a first bypass line having a first flow regulating valve is interposed between said pressure oscillation source and said high-temperature end portion of said first pulse tube, and a second bypass line having a second flow regulating valve is interposed between said pressure oscillation source and said high-temperature end portion of said second pulse tube, and a third bypass line having a third flow regulating valve is interposed between said pressure oscillation source and said high-temperature end portion of said third pulse tube.

* * * * *